US008544556B2

(12) United States Patent
Sundholm et al.

(10) Patent No.: US 8,544,556 B2
(45) Date of Patent: Oct. 1, 2013

(54) SPRINKLER

(75) Inventors: Goran Sundholm, Tuusula (FI); Harry Metzger, Kerava (FI)

(73) Assignee: Marioff Corporation Oy, Vantaa (FI)

( * ) Notice: Subject to any disclaimer, the term of this patent is extended or adjusted under 35 U.S.C. 154(b) by 845 days.

(21) Appl. No.: 12/086,787

(22) PCT Filed: Feb. 11, 2007

(86) PCT No.: PCT/FI2007/000010

§ 371 (c)(1),
(2), (4) Date: Dec. 5, 2008

(87) PCT Pub. No.: WO2007/082988

PCT Pub. Date: Jul. 26, 2007

(65) Prior Publication Data

US 2009/0166047 A1 Jul. 2, 2009

(30) Foreign Application Priority Data

Jan. 18, 2006 (FI) ..... 20060022 U
Mar. 6, 2006 (FI) ..... 20060217

(51) Int. Cl.
*A62C 37/08* (2006.01)
*A62C 35/00* (2006.01)
*A62C 37/36* (2006.01)

(52) U.S. Cl.
USPC ..... 169/37; 169/16; 169/20; 169/51

(58) Field of Classification Search
USPC ..... 169/5, 16, 17, 19, 20, 37, 51, 90
See application file for complete search history.

(56) References Cited

U.S. PATENT DOCUMENTS 2,389,331 A * 11/1945 Tyden ..... 169/37
3,633,676 A * 1/1972 Gloeckler ..... 169/40
3,727,695 A * 4/1973 Danton ..... 169/37
3,998,273 A * 12/1976 Juliano ..... 169/37
4,596,289 A 6/1986 Johnson (Continued)

FOREIGN PATENT DOCUMENTS

EP 1 150 747 11/2001
WO 01/26741 4/2001

*Primary Examiner* — Len Tran
*Assistant Examiner* — Justin Jonaitis
(74) *Attorney, Agent, or Firm* — Ladas & Parry LLP

(57) ABSTRACT

A sprinkler which comprises a sprinkler frame (2), in which there is at least one nozzle (3), a heat-activated triggering element (5), and a protective element (8) which is in front of the nozzle (3) in the protective position and mechanically protects the triggering element (5) when the sprinkler is in a non-active mode, and which protective element (8) is movable to a second position in which the nozzles (3) and the triggering element (5) are not protected by the protective element (8). The sprinkler frame (2) is movable in relation to a fastening frame (1) between two positions, a first position in which the sprinkler is in a non-active mode, and a second position in which the sprinkler frame is protruding, and which sprinkler frame (2) is arranged movable from the effect of the pressure of medium in relation to the fastening frame (1) from the first position to the second position and at the same time to direct a force to the protective element (8) for moving it from the protective position to the second position, whereby the sprinkler is in the second position of the sprinkler frame set to a standby mode.

7 Claims, 3 Drawing Sheets

(56) References Cited

U.S. PATENT DOCUMENTS 4,880,063 A 11/1989 Leininger et al.
5,020,601 A 6/1991 Retzloff et al.
5,501,282 A 3/1996 Sundholm
6,296,062 B1 * 10/2001 Sundholm ..... 169/37

* cited by examiner

SPRINKLER

BACKGROUND OF THE INVENTION

The invention relates to a sprinkler according to the preamble of claim 1 which comprises a sprinkler frame, in which there is at least one nozzle, a heat-activated triggering element, and a protective element which is in front of the nozzle in the protective position and mechanically protects the triggering element when the sprinkler is in a non-active mode, and which protective element is movable to a second position in which at least one nozzle and triggering element are not protected by the protective element.

A sprinkler of this type especially intended for fire extinguishing is known e.g. from publication EP1150747. A cup part protecting the nozzles and the triggering element of the sprinkler head is released by a device which is movable in relation to the holder frame. The publication presents some different alternatives for releasing the cup part and for bringing the sprinkler to a stand-by position.

The object of this invention is, inter alia, to further develop the solution presented in the publication. A second object of the invention is to provide, inter alia, a combination simpler than earlier and excellent in reliability for a spraying head, especially for a sprinkler and devices for releasing the protective cup of the sprinkler.

BRIEF DESCRIPTION OF THE INVENTION

The invention is based on an idea in which the sprinkler head is arranged movable between two positions, whereby the sprinkler head functions as a release means of the protective cup.

It is characteristic for the sprinkler according to the invention that the sprinkler frame is movable in relation to the fastening frame between two positions, a first position in which the sprinkler is in a non-active mode, and a second position in which the sprinkler frame is protruding, and which sprinkler frame is arranged movable from the effect of the pressure of medium in relation to the fastening frame from the first position to the second position and at the same time to direct a force to the protective element for moving it from the protective position to the second position, whereby the sprinkler is in the second position of the sprinkler frame set to a standby mode.

The apparatus according to the invention is further characterised by what is stated in claims 2-6.

The solution according to the invention has numerous significant advantages. By arranging the sprinkler head movable and by using it for releasing the protective cup, an extremely well functioning solution is provided for bringing the sprinkler intended for difficult circumstances to a standby mode. By using extinguishing medium for moving the sprinkler head, an advantageous combination is provided for means for removing the protective element from the front of the sprinkler head. By using the sprinkler head, adequately large surfaces can be provided for changing the pressure of medium to a moving force directed to the protective element. By arranging the sprinkler frame two-piece so that a limiting element is connected from a different side of the fastening frame to the actual sprinkler frame, an extremely applicable solution is provided in respect of its manufacturing technique. The combination of the fastening frame and the sprinkler frame can then be connected easily as one unity to suitable fastening parts. The solution is extremely applicable to be located in circumstances in which protecting the sprinkler head is necessary from, inter alia, the surrounding circumstances. Such are e.g. traffic tunnels. The solution is extremely applicable namely for fire-extinguishing applications and especially for applications in which liquid-bearing medium mist is used as the extinguishing medium.

BRIEF DESCRIPTION OF THE FIGURES

Next, the invention will be described in detail by means of an example with reference to the accompanying drawing in which.

DETAILED DESCRIPTION OF THE INVENTION

Figure 1:
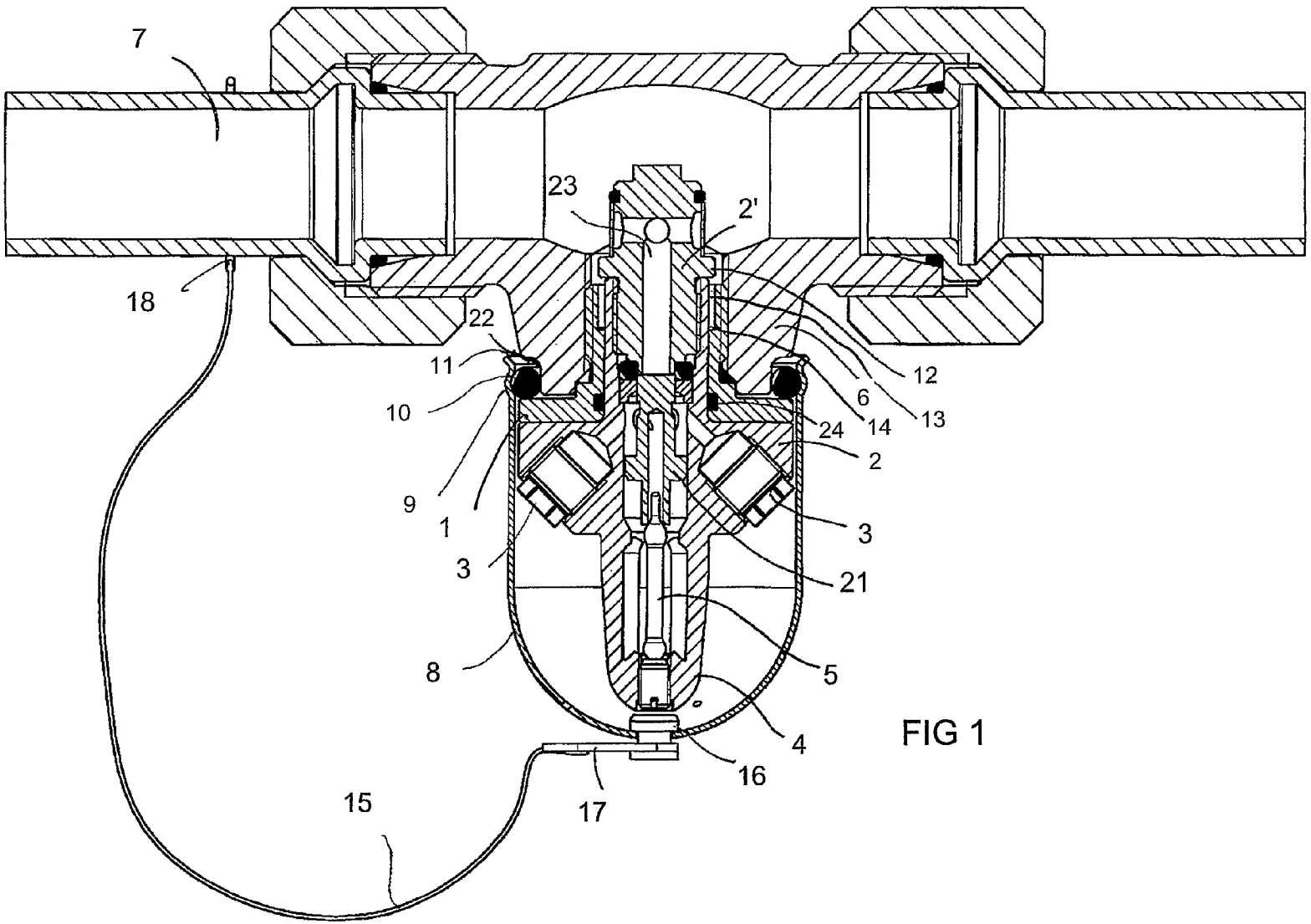
FIG. 1 shows a cross-section of an apparatus according to the invention in a first position.
Figure 2:
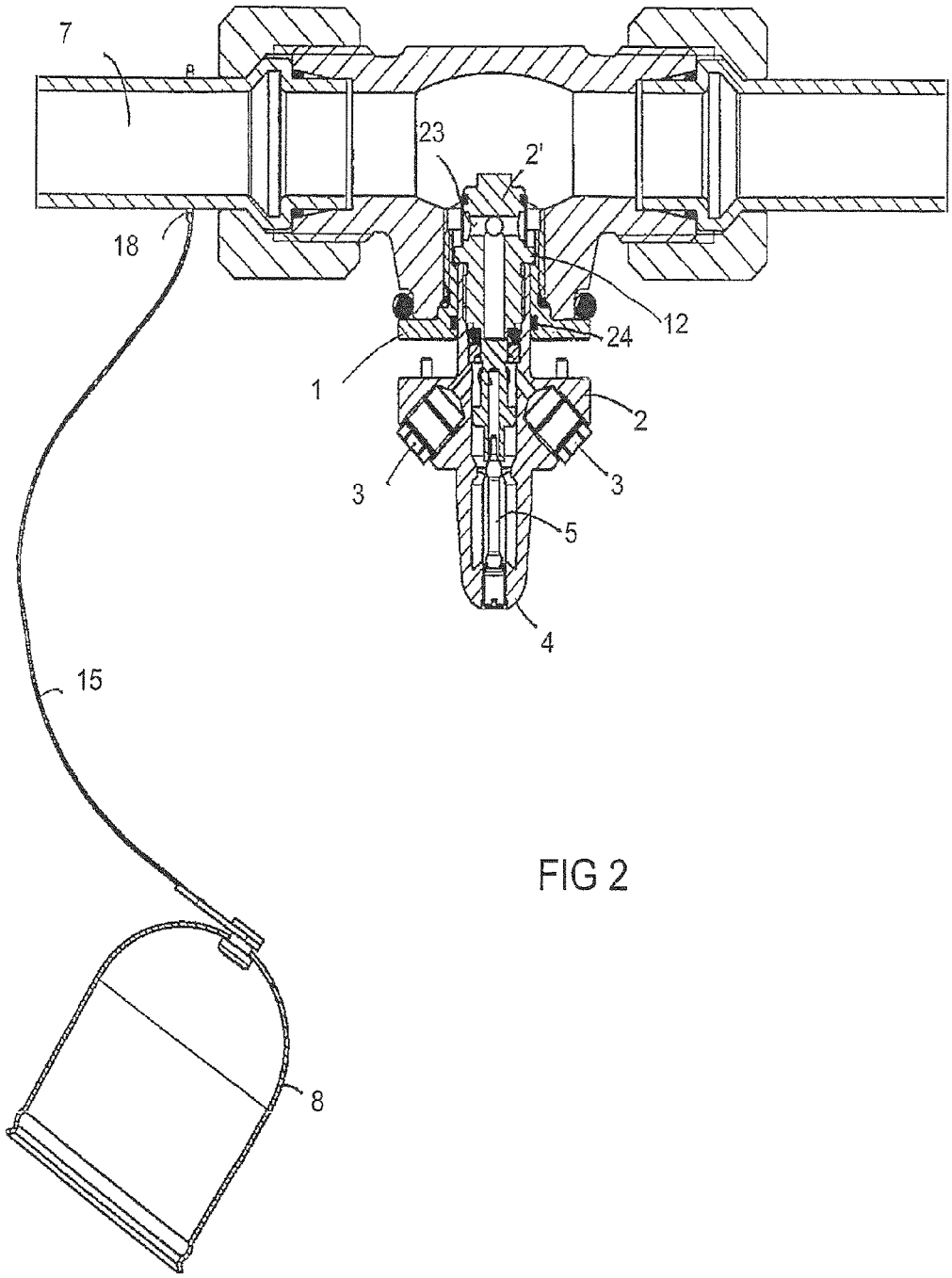
FIG. 2 shows a cross-section of an apparatus according to the invention in a second position i.e. standby position.

FIG. 1 shows a cross section of a sprinkler according to the invention in a first position. A fastening frame 1 of the sprinkler is arranged to a fastening part 6 arranged to a pipeline 7. A frame part of the sprinkler i.e. sprinkler frame 2 is arranged movable in relation to the fastening frame 1 between at least one first position i.e. non-active position (FIG. 1) and one second position i.e. standby position (FIG. 2). At least one nozzle 3 is arranged to the frame part 2 of the sprinkler. There are several nozzles 3 in the sprinkler of the figure. To the sprinkler is arranged a triggering means 5, such as a heat-sensitive triggering means, e.g. an ampoule breaking in a certain temperature. The ampoule 5 is arranged between a support frame 4 in the lower part of the sprinkler frame 2 in FIG. 1 and a valve element 21 of the sprinkler, i.e. valve stem, keeping the passage of the medium closed between an inlet 23 and the nozzles 3 of the sprinkler at least in the non-active position and the standby position.

To the fastening frame 1 of the sprinkler is arranged a channel 13 in which the sprinkler frame is movable between the first position and the second position. When the pressure of the medium in the piping 7 increases, the pressure affects the surfaces of the frame part 2 of the sprinkler which surfaces are formed such that the sprinkler frame moves in the channel 13 of the fastening frame 1 from the first position to the second position, i.e. so far as a counter-surface 14 of the fastening frame. In the sprinkler frame, there is a shoulder 12 which fits to the counter-surface 14 of the fastening frame. The shoulder 12 functions thus as a limiting part. As a result of moving, the sprinkler frame 2 affects a protective element 8. The protective element 8 detaches from the locked position (FIG. 1) and moves away from the front of the triggering means and the nozzles (FIG. 2). The sprinkler frame 2 is formed comprising two pieces, whereby the part 2' comprising the shoulder 12 can be joined to the part of the sprinkler frame comprising the nozzles 3 from the opposite sides of the fastening frame 1 in the assembly stage.

The sprinkler comprises the sprinkler frame 2, in which there is at least one nozzle 3, the heat-activated triggering element 5, and the protective element 8 which is in front of the nozzle 3 in the protective position and mechanically protects the triggering element 5 when the sprinkler is in the non-active mode, and which protective element 8 is movable to the second position in which at least one nozzle 3 and triggering element 5 are not protected by the protective element 8. The sprinkler frame 2 is movable in relation to the fastening frame 1 between two positions, the first position in which the sprinkler is in the non-active mode, and the second position in which the sprinkler frame is protruding, and which sprinkler frame 2 is arranged movable from the effect of the pressure of medium in relation to the fastening frame 1 from the first position to the second position and at the same time to direct a force to the protective element 8 for moving it from the protective position to the second position, whereby the sprinkler is in the second position of the sprinkler frame set to the standby mode. The fastening frame 1 comprises the channel part 13 i.e. cylinder space, whereby at least a part of the sprinkler frame 2 is formed as a piston part which is arranged to move from the effect of the pressure of the medium in the cylinder space from the first position to the second position. A sealing element 24, such as a sliding ring or equivalent, is arranged to the fastening frame 1 to a bore forming its cylinder space.

In an embodiment, the medium used for moving the frame part of the sprinkler head i.e. sprinkler frame is typically extinguishing medium. It is also possible to use some other suitable medium.

In the protective position, the protective element 8 extends to the fastening frame 1 or its vicinity. An edge area 11 of the cup-like protective element 8 extends in the embodiment of FIG. 1 over the outer race of the fastening frame 1 so far as the fastening part 6. In the fastening point of the protective element 8 in the fastening frame 1 or its vicinity, there is a sealing element 10, such as a ring seal. To the fastening point is formed a groove 22 in which the sealing element 10 is arranged.

The sprinkler frame 2 comprises the limiting element 12 of motion, such as a shoulder, and the fastening frame comprises the counter-surface 14 for it.

The sprinkler frame comprises a support part 4 which is arranged to direct an adequate force to the protective element 8.

Thus, the sprinkler comprises the cup-like protective element 8 which protects the triggering means 5 and the nozzles 3. The protective element 8 is fastened in the solution according to FIG. 1 by means of the sealing element 10, most suitably an annular seal, to the protective position (FIG. 1). The annular seal 10 is arranged to the groove 22 formed in the connection point between the fastening frame 1 and the fastening part 6. To the protective part 8 is formed a groove 9 for the annular seal 10. The groove 9 and the annular seal 10 of the protective part form a locking which keeps the protective part in its place in the protective position. Because of the ring seal 10, the protective element keeps well in its place in the protective position, whereby the vital parts of the sprinkler are well protected from the effects of the sprinkler surroundings. Such parts intended for protection are, inter alia, the triggering means 5, typically an ampoule, and the nozzles 3. The sprinkler can be placed to very different environments where it is exposed to impurities and dirtying which might impede the functioning of the sprinkler, inter alia, to cause malfunctions of the sprinkler without the protective element 8. Furthermore, the protective element 8 prevents the unwanted triggering of the triggering means 5 e.g. as a result of a short hot gas flow directed to the sprinkler. Such situations can occur, inter alia, in road tunnels where e.g. exhaust gases of a lorry can momentarily be directed straight at the sprinkler.

Figure 3:
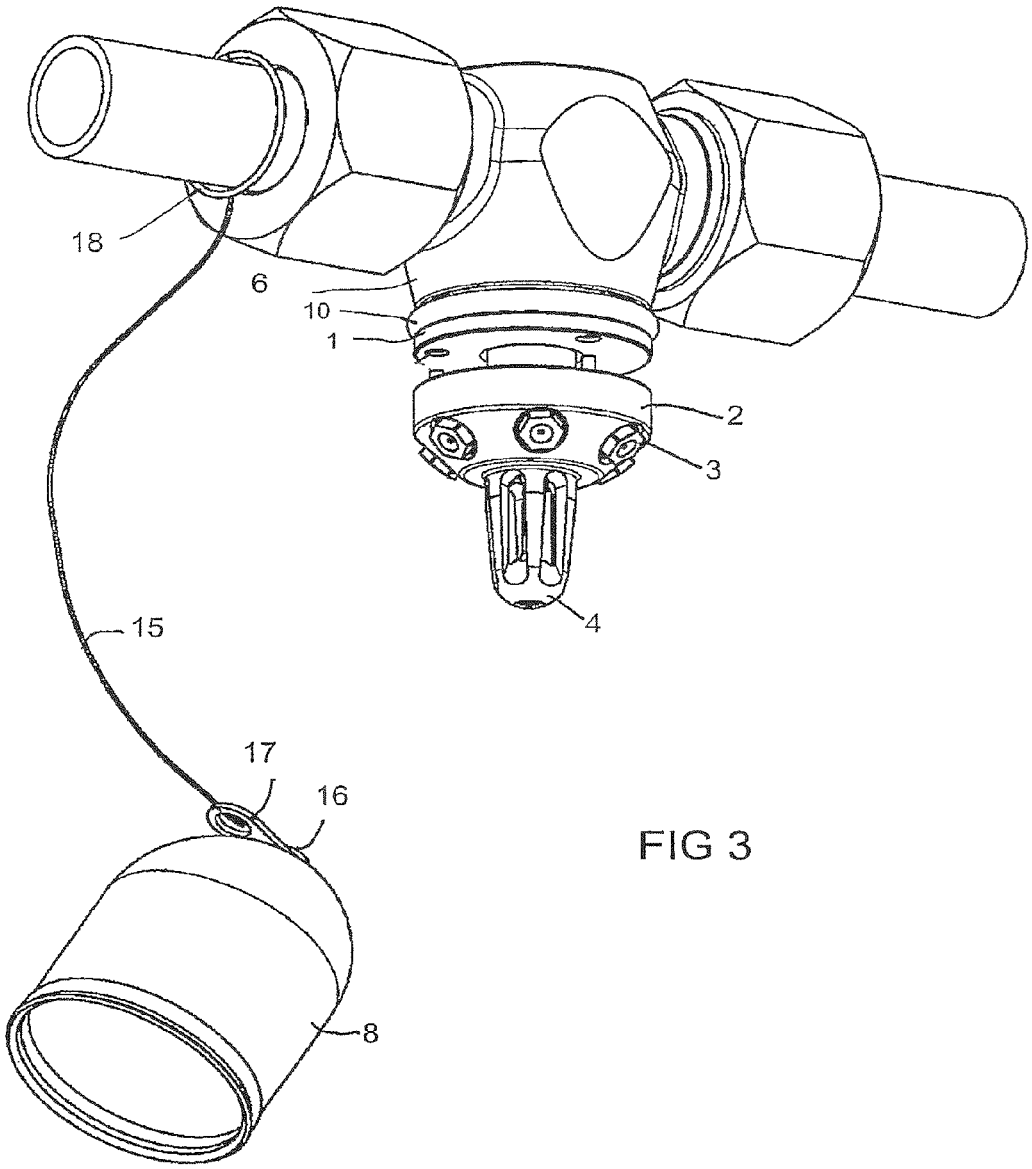
FIG. 3 shows an apparatus according to the invention in the second position i.e. standby position.

The sprinkler can be set to a standby mode by conveying medium with pressure to the pipe 7. Because of this the pressure of the medium is directed against the surfaces of the sprinkler, whereby is caused a force which pushes the sprinkler frame 2 in the fastening frame 1 from the first position towards the second position i.e. downwards in FIG. 1. The sprinkler frame 2, for its part, affects the protective part 8, whereby when the force directed by the sprinkler frame 2 to the protective element 8 exceeds the force keeping the protective element in its place, the protective element detaches from its place to the non-protective position according to FIGS. 2 and 3. The sprinkler frame 2 affects the protective element 8 in the figure in the direction of motion of the sprinkler frame at its outermost part i.e. the support frame 4. In the solution according to the figure, to the protective element 8 is arranged fastening elements 16, 17 for a coupling part 15 by means of which a harmful falling of the protective element 8 is prevented. The coupling part 15 is e.g. a banded part, such as a cord, wire or equivalent or a chain-like part. In the figure, the coupling part 15 is fastened to the protective element 8 and from its other end to the pipe 7 by a fastening ring 18, whereby the detached protective element 8 remains hanging held by the coupling part 15.

In the standby mode (FIGS. 2 and 3), the sprinkler can be activated in a usual way by means of the triggering means 5, e.g. when it has been broken as a result of heat, whereby the nozzles 3 can spray extinguishing medium. In the standby mode, the sprinkler frame 2 according to the invention extends somewhat away from the fastening frame, whereby it is, on one hand, closer to a possible fire site and, on the other hand, a distance away from the fastening point e.g. a ceiling or wall surface.

Typically, the extinguishing medium pipe 7 is a so-called dry pipe, whereby it does not contain extinguishing medium. When extinguishing medium is conveyed to the pipe 7, the extinguishing medium affects in a manner described above by moving the sprinkler frame from the first position to the second position and to the standby mode, whereby also the protective element 8 is detached from its locking. After the ampoule 5 of the sprinkler in the standby mode has been broken e.g. from the result of heat, extinguishing medium starts to spray from the nozzles 3 of the sprinkler.

A sprinkler according to the invention is especially suitable for spraying liquid-bearing extinguishing medium mist. On applications and characteristics of the sprinkler, we refer to publications EP1150747 and WO01/26742.

It is obvious to those skilled in the art that the invention is not limited to the embodiments described above, but it may be varied within the scope of the enclosed claims. When necessary, the features possibly described in this specification together with other features may also be used separate from each other.

The invention claimed is:

1. A sprinkler which comprises a sprinkler frame (2), in which there is at least one nozzle (3), a heat-activated triggering element (5), and a protective element (8) which is in front of the nozzle (3) in the protective position and mechanically protects the triggering element (5) when the sprinkler is in a non-active mode, and which protective element (8) is movable to a second position in which at least one nozzle (3) and triggering element (5) are not protected by the protective element (8), wherein the sprinkler frame (2) is movable in relation to a fastening frame (1) between two positions, a first position in which the sprinkler is in a non-active mode, and a second position in which the sprinkler frame is protruding, and which sprinkler frame (2) is arranged movable from the effect of the pressure of medium in relation to the fastening frame (1) from the first position to the second position and at the same time to direct a force to the protective element (8) for moving it from the protective position to the second position so that the fastening frame (1) directly applies a force to the protective element (8), whereby the sprinkler is in the second position of the sprinkler frame set to a standby mode.

2. A sprinkler according to claim 1, wherein the medium is extinguishing medium.

3. A sprinkler according to claim 1, wherein the fastening frame (1) comprises a cylinder space (13), and at least a part of the sprinkler frame (2) is formed as a piston part which is arranged to move from the effect of the pressure of the medium in the cylinder space (13) from the first position to the second position.

4. A sprinkler according to claim 1, wherein the sprinkler frame (2) comprises a limiting element (12) of motion and the fastening frame (1) comprises a counter-surface (14) for the limiting element.

5. A sprinkler according to claim 4, wherein the sprinkler frame (2) is formed comprising two parts, whereby the limiting element (12) is in the first part (2') and the nozzles (3) in the second part (2).

6. A sprinkler according to claim 1, wherein the sprinkler frame (2) comprises a support part (4) which is arranged to direct an adequate force to the protective element (8).

7. A sprinkler according to claim 1, wherein the protective element (8) extends in the protective position to the fastening frame (1) or its vicinity.

* * * * *

UNITED STATES PATENT AND TRADEMARK OFFICE

CERTIFICATE OF CORRECTION

PATENT NO. : 8,544,556 B2
APPLICATION NO. : 12/086787
DATED : October 1, 2013
INVENTOR(S) : Goran Sundholm et al.

It is certified that error appears in the above-identified patent and that said Letters Patent is hereby corrected as shown below:

Title page, item (22), PCT Filed: "Feb. 11, 2007" should read --Jan. 11, 2007--.

Signed and Sealed this
Twenty-eighth Day of January, 2014

Michelle K. Lee

Michelle K. Lee
*Deputy Director of the United States Patent and Trademark Office*